US010683623B2

(12) United States Patent
Brand et al.

(10) Patent No.: US 10,683,623 B2
(45) Date of Patent: Jun. 16, 2020

(54) ELONGATE TENSIONING UNIT

(71) Applicant: DYWIDAG-Systems International GmbH, Munich (DE)

(72) Inventors: Werner Brand, Freising (DE); Thomas Kahl, Erding (DE); Marcel Kasper, Munich (DE)

(73) Assignee: DYWIDAG-Systems International GmbH, Munich (DE)

( * ) Notice: Subject to any disclaimer, the term of this patent is extended or adjusted under 35 U.S.C. 154(b) by 0 days.

(21) Appl. No.: 16/667,165

(22) Filed: Oct. 29, 2019

(65) Prior Publication Data

US 2020/0080268 A1 Mar. 12, 2020

Related U.S. Application Data

(63) Continuation of application No. 16/333,383, filed as application No. PCT/EP2017/068323 on Jul. 20, 2017, now abandoned.

(30) Foreign Application Priority Data

Oct. 19, 2016 (DE) ..... 10 2016 220 478

(51) Int. Cl.
*E04F 19/00* (2006.01)
*E01D 19/16* (2006.01)
(Continued)

(52) U.S. Cl.
CPC ..... *E01D 19/16* (2013.01); *D07B 1/147* (2013.01); *D07B 1/148* (2013.01); *E01D 11/04* (2013.01);
(Continued)

(58) Field of Classification Search
None
See application file for complete search history.

(56) References Cited

U.S. PATENT DOCUMENTS 4,090,168 A * 5/1978 Miller ..... B63G 8/42 174/101.5
4,612,680 A * 9/1986 Daiguji ..... E01D 19/16 14/22
(Continued)

FOREIGN PATENT DOCUMENTS

CN 201269444 7/2009
CN 202281125 6/2012
(Continued)

OTHER PUBLICATIONS

German Search Report of German patent application 10 2016 220 478.5 dated Jun. 8, 2017, 8 pages.
(Continued)

*Primary Examiner* — Basil S Katcheves
(74) *Attorney, Agent, or Firm* — Rankin, Hill & Clark LLP

(57) ABSTRACT

The invention relates to an elongate tensioning unit comprising a casing which encloses an interior space, and a plurality of tensioning elements which extend in the longitudinal direction of the tensioning unit and are accommodated in the interior space of the casing. According to the invention, the casing comprises, at, at least one circumferential position, a depression which projects into the interior space and in which at least one electric functional unit, for example at least one lighting unit, and at least one connection line for the at least one electric functional unit are accommodated. Alternatively, the at least one electric functional unit can also be accommodated in an associated recess in a water-repelling element arranged on the outer surface of the casing.

22 Claims, 5 Drawing Sheets

(51) Int. Cl.

| | |
|---|---|
| ***D07B 1/14*** | (2006.01) |
| ***E04H 12/20*** | (2006.01) |
| ***E01D 11/04*** | (2006.01) |
| ***F21V 23/00*** | (2015.01) |
| *F21V 33/00* | (2006.01) |
| *F21Y 115/10* | (2016.01) |

(52) U.S. Cl.
CPC ..... *E04H 12/20* (2013.01); *F21V 23/001* (2013.01); *D07B 2201/2085* (2013.01); *D07B 2201/2086* (2013.01); *D07B 2201/2087* (2013.01); *D07B 2501/203* (2013.01); *F21V 33/00* (2013.01); *F21Y 2115/10* (2016.08)

(56) References Cited

U.S. PATENT DOCUMENTS

| | | | | |
|---|---|---|---|---|
| 5,173,982 | A * | 12/1992 | Lovett | E01D 19/14 14/22 |
| 5,479,671 | A * | 1/1996 | Stubler | E01D 19/16 14/22 |
| 6,138,309 | A * | 10/2000 | Tadros | E01D 1/005 14/22 |
| 6,386,526 | B1 * | 5/2002 | Sarkar | E01D 19/16 174/40 R |
| 2002/0170792 | A1 * | 11/2002 | Phelan | E01D 19/16 188/378 |
| 2007/0062174 | A1 * | 3/2007 | Clough | D07B 1/068 57/212 |
| 2007/0218751 | A1 * | 9/2007 | Ward | F21S 2/00 439/404 |
| 2012/0243225 | A1 | 9/2012 | Lee et al. | |
| 2015/0113936 | A1 * | 4/2015 | Amils | F16G 11/042 57/216 |
| 2017/0045183 | A1 * | 2/2017 | Beijer | F21K 9/275 |
| 2017/0275868 | A1 * | 9/2017 | Scherrer | E04B 9/303 |

FOREIGN PATENT DOCUMENTS

| | | |
|---|---|---|
| CN | 202403211 | 8/2012 |
| KR | 10-0901165 | 6/2009 |
| WO | 2001044680 | 6/2001 |

OTHER PUBLICATIONS

Written Opinion and International Search Report of PCT/EP2017/068323 dated Oct. 11, 2017, 11 pages (English and German).

International Preliminary Report on Patentability of International patent application No. PCT/EP2017/068323 dated Apr. 23, 2019, 6 pages.

* cited by examiner

ELONGATE TENSIONING UNIT

CROSS-REFERENCE TO RELATED APPLICATION

This application is a continuation of U.S. patent application Ser. No. 16/333,383 filed on Mar. 14, 2019, which is a national stage application of International Patent Application No. PCT/EP2017/068323 filed on Jul. 20, 2017, each of which is incorporated herein by reference in its entirety.

DESCRIPTION

The invention relates to an elongate tensioning unit comprising a casing which encloses an interior space, and a plurality of tensioning elements which extend in the longitudinal direction of the tensioning unit and are accommodated in the interior space of the casing.

Primarily for design reasons, for quite some time now, a popular approach has been to illuminate elongate tensioning units, for example stay cables, as used in cable-stayed bridges, towers and similar structures. Initially, the structures were illuminated indirectly by means of spotlights. However, this was disadvantageous in that only a small fraction of the light emitted was reflected by the relevant structure or the tensioning units thereof. Therefore, light sources having correspondingly large dimensions had to be provided, meaning that high operating costs were incurred owing to the power consumption associated therewith. Moreover, the intended design effect could not be achieved to the desired extent.

In order to solve this problem, it was proposed that the light elements are arranged directly on the tensioning units. For example, CN 202403211 U discloses attaching the light elements to the tensioning unit at a later stage by means of clamps. This solution is disadvantageous primarily due to the increased tendency of the tensioning units retrofitted in this manner to oscillate, as a result of the increased air resistance caused by turbulent flows around the light elements.

In addition, CN 202403211 U also discloses encasing the tensioning unit in an additional shell in which the light elements are accommodated. Although this embodiment has a substantially circular cross section and thus improved aerodynamic properties by comparison with the previously described embodiment from CN 202403211 U, it is nevertheless disadvantageous in that the cross-sectional area of the tensioning unit encased in the shell is significantly increased and thus the air resistance of the tensioning unit is significantly increased as well. Furthermore, the costs of providing said unit, which costs are increased as a result of the additional shell, are disadvantageous. In addition, attaching the additional shell at a later stage makes it more difficult to perform maintenance on the tensioning units and to illuminate said tensioning units.

The problem addressed by the invention is to provide a remedy for this.

This problem is solved according to the invention by an elongate tensioning unit of the type mentioned at the outset in which the casing comprises, at at least one circumferential position, a depression which projects into the interior space thereof and in which at least one electric functional unit, for example at least one lighting unit, and at least one connection line for the at least one electric functional unit are accommodated.

The inventors have found that the arrangement of the tensioning elements in the interior space of the casing can be selected in an arbitrary manner. All that matters is that there is the necessary number of tensioning elements for the load-bearing capacity of the tensioning unit that is required in each case. This makes it possible for at least one depression which projects into the interior space to be provided on the outer contour of the casing that is responsible for the aerodynamic properties of the tensioning unit, in which depression the electric functional unit can be accommodated. Advantageously, according to the invention, the tensioning elements can also be arranged in portions of the cross-sectional surface of the interior space of the casing that are at the same height in the radial direction, but, in the circumferential direction, are positioned between two adjacent side delimiting walls of a depression or a plurality of depressions.

As a whole, the cross-sectional surface of the interior space is of a shape other than a circle.

Since the wall thickness of the casing can remain substantially constant, the cross-sectional area of the casing and thus of the entire tensioning unit is increased only slightly, namely precisely by the cross-sectional area that is necessary for arranging the at least one depression which accommodates the electric functional unit. Furthermore, by means of the solution according to the invention, the number of components required for arranging the at least one electric functional unit is reduced, and this has a beneficial effect on the cost of production.

Owing to the fact that the at least one depression projects into the interior space of the casing, the casing can be designed having no hollow regions, advantageously having no hollow regions that do not have any tensioning elements arranged therein. Since the casing material required to form hollow regions of this kind can thus be economised, the tensioning unit according to the invention can be produced in a more cost-effective manner.

As previously mentioned, the at least one electric functional unit can advantageously be a lighting unit. In principle, however, it is also conceivable for other types of electric functional units to be provided, for example sensor units.

Regardless of the type of the electric functional unit(s), a plurality of depressions can be arranged so as to be distributed over the circumference of the casing. If the functional units are lighting units, so as to be able to ensure that the tensioning unit is clearly visible from all directions, it is proposed that at least three depressions are arranged so as to be distributed over the circumference of the casing.

At this juncture, for the sake of completeness, it is noted that the tensioning unit according to the invention can also be a tensioning cable, for example a stay cable, as used in cable-stayed bridges, towers and similar structures.

Even if a plurality of electric functional units are provided that are arranged only at predetermined positions in the longitudinal direction of the tensioning unit, it is advantageous for the at least one depression to extend over at least a predetermined fraction of the length of the tensioning unit, preferably over substantially the entire length of the tensioning unit. In principle, it is thus conceivable for the electric functional units to be provided only in one longitudinal portion or a plurality of longitudinal portions of the tensioning unit that are separated from one another.

In a development of the invention, it is proposed that the depression comprises a top wall which extends in the extension of the circumferential extent of the outer surface of the casing. In other words, the top wall extends substantially along the lateral face of the casing. By means of this development, the at least one electric functional unit can be prevented from projecting beyond the outer surface of the casing. Therefore, said electric functional unit cannot provide a raised contact surface for wind and/or weather.

If the electric functional elements are provided only at specified positions on the longitudinal extent of the tensioning unit, the top wall can be formed between these positions, at least in portions, on a rail element inserted into the relevant depression. In this case, the rail elements can be approximately one metre to two metres in length, for example.

Additionally or alternatively, it is however also conceivable for the top wall to be formed in one piece with the casing surface at least in part.

In this case, the top wall may only extend over a fraction of the opening width of the depression in the circumferential direction of the casing, as a result of which the depression comprises an undercut on one longitudinal edge or on both longitudinal edges, in which undercut the at least one connection line for the electric functional unit can be arranged.

In order to be able to design the tensioning unit so as to be particularly resistant to external forces, applied for example by the wind and/or weather, it is proposed that the top wall comprises a plurality of apertures that corresponds to the number of electric functional units. Specifically, in this way, the casing can extend over the entire circumference of the tensioning unit on a large portion of the length of the tensioning unit, and therefore the only gaps in said casing are those made by the openings required for inserting the electric functional units.

These apertures or openings can be circular, oval, rectangular, square, polygonal or can have any other shape, depending on the use in each case.

Furthermore, the apertures or openings can be made as early as at the point of producing the casing or when the tube portion intended for forming the casing is produced. In principle, however, it is also conceivable, if necessary, for the apertures or openings to be made in the casing only once at the construction site.

The at least one connection line can be an energy supply line, in particular a line for supplying electrical energy to the at least one electric functional unit, and/or a data line for establishing a unidirectional or bidirectional data connection to the at least one electric functional unit.

If the functional units are lighting units, a single energy supply line is sufficient if the earth line is formed by a rail, for example, that is inserted into the depression and supports the lighting units. However, the earth line can also be designed as a separate energy supply line. If the intensity and/or colour of the light emitted by the lighting units is intended to be varied, a data line can also be provided for establishing unidirectional communication between a control unit and the lighting units. If status information is also intended to be retrieved from the lighting units, at least one additional data line for establishing a unidirectional data connection or one data line for establishing a bidirectional data connection can be provided. Similar considerations also apply when the electric functional units are sensor units.

In order to keep the depth of the at least one depression as small as possible with a view to making the casing stable, it is proposed in a development of the invention that the at least one connection line extends in front of and/or behind the electric functional unit when viewed in the circumferential direction, i.e. extends beside the electric functional unit on one side or on both sides when viewed in the longitudinal direction of the tensioning unit. If provided, the at least one connection line can be arranged in an above-mentioned undercut.

As is known per se, the casing can have a substantially circular cross section.

In order to be able to protect the electric functional units from the influence of moisture, for example rain, it can also be provided that sealing elements are assigned to the delimiting walls of the depressions, which sealing elements are preferably arranged adjacently to the transition between the delimiting walls and the outer circumferential surface of the casing.

So as to be able to replace functional units that are no longer working properly, it is proposed that the at least one electric functional unit can be detachably connected to the casing of the tensioning unit. For this purpose, the electric functional unit itself can be detachably connected to the casing or to a base element that is connected to said casing for operation therewith. Conversely, it is also conceivable for one or more electric functional units to be arranged on a support element for operation therewith, which support element is detachably connected to the casing or to a base element that is connected to said casing for operation therewith.

The detachable connection can be produced, for example, by screwing, locking, clamping, using a bayonet-like connection or the like. In this case, electrical contacts can be produced in a manner known per se. The connection for conjoint operation can be produced, for example, by adhesion, clips, clamps, screws or the like. In this respect, there does not need to be a connection over the entire length of the base element. Instead, it is sufficient for a connection to be provided at at least one point, preferably at at least two points.

The functional units can be replaced by means of a robot, for example, which can move along the tensioning unit autonomously.

The casing of the tensioning unit can be made of plastics material for example, preferably high-density polyethylene (HDPE), or of steel, preferably corrosion-protected steel, in particular corrosion-protected stainless steel.

In a development of the invention, the inner delimiting wall of the at least one depression can be formed in one piece with the casing. In this case, the inner delimiting wall of the at least one depression can be formed together with the casing when said casing is extruded. However, alternatively, it is also conceivable for the inner delimiting wall of the at least one depression to be formed as a separate element and to be connected to the casing for operation therewith. In this case, the inner delimiting wall of the at least one depression can be made of the same material as the casing or of a different material from that of the casing. For example, the casing can be made of plastics material, preferably high-density polyethylene (HDPE), and the inner delimiting wall of the at least one depression can be made of steel, preferably corrosion-protected steel, in particular corrosion-protected stainless steel.

As previously mentioned, the casing is usually formed from tube portions of a predetermined length that are then interconnected by welding, for example butt-welding. Similarly, the connection lines and/or the base elements to be inserted into the depressions can be assembled from portions of a predetermined length.

In a development, it is proposed that the lighting unit comprises at least one lamp. In principle, however, it is also conceivable for a plurality of lamps to be used, whether as a reserve, for example in order to reduce maintenance requirements, or in order for it to be possible to achieve specific optical effects, in particular a change in the colour of the light emitted.

In view of energy consumption, but also heat emission, concerning the operation of the lighting unit, it is proposed that the at least one lamp is formed by an LED. In principle, however, it is also conceivable for other types of lamps to be used, for example halogen lamps, fluorescent elements or the like.

So as to be able to improve the visibility of the lighting unit irrespective of the viewing angle, it can be provided that the at least one lighting unit comprises an integrated optical system, preferably a dispersive optical system.

Moreover, the lighting unit can comprise a local control unit which is used to actuate the at least one lamp, for example according to the instructions from a central control unit for controlling all of the lighting units of the tensioning unit or at least a plurality of tensioning units, preferably all of the tensioning units, of the structure.

For the sake of completeness, it should also be noted that at least some of the tensioning elements can be designed as tensioning strands, in a manner known per se. For example, the tensioning strands can be formed of seven wires and/or can have a diameter of approximately 15.7 mm. However, alternatively, it is also conceivable for the tensioning elements to be formed of non-stranded wires that extend substantially in parallel with one another, these wires preferably having a diameter of approximately 7.0 mm.

It should also be noted that at least one water-repelling element can be provided on the outer surface of the casing, which water-repelling element is used to remove water, in particular rain water, from the outer surface of the casing, which water has accumulated on the outer surface of the casing and is trickling along the tensioning unit there as a result of wind and weather, and to release said water into the surrounding air where it is carried away from the tensioning unit by the wind and weather. Water-repelling elements of this kind can preferably be formed as ridges protruding from the outer surface of the casing, which ridges may, for example, be in the form of a helix winding around the casing in the longitudinal direction of the tensioning unit or in the form of a ring surrounding the casing. The course of the transition between the outer surface of the casing and the ridge and/or the free end of the ridge can in this case be designed in an optimal manner with a view to conducting the water away in the most efficient manner possible.

Finally, it should also be noted that, when the tensioning unit is in the ready-to-use state, the interior space of the casing can be filled at least in part, preferably completely, with a filler, preferably an anti-corrosion material, for example wax, mortar or the like.

According to another aspect, the problem addressed by the invention is solved by a tensioning unit of the type mentioned at the outset in which at least one water-repelling element is arranged on the outer surface of the casing, which water-repelling element comprises at least one recess in which at least one electric functional unit, for example at least one lighting unit, is accommodated, and which also comprises at least one connection line for the at least one electric functional unit.

This alternative solution produces the same technical advantages as the solution discussed above. Therefore, for more details on this solution, reference can be made to the above discussion. This solution is associated with the technical concept that is common to the two solutions and not disclosed by the prior art of integrating the at least one electric functional unit in the casing of the tensioning unit.

In a development of the alternative solution, it is proposed that the at least one connection line is accommodated in a channel which is formed in the at least one water-repelling element. Alternatively, however, it is also conceivable for the casing to comprise a depression which projects into the interior space at at least one circumferential position and in which the at least one connection line is accommodated.

Finally, it should be noted that, in the tensioning unit according to this additional aspect, the tensioning elements can be formed not only by wires stranded to form strands or non-stranded wires that extend substantially in parallel with one another, but also by completely stranded wires, i.e. wires that have been stranded to form a single cable.

The invention is explained in more detail in the following with reference to the accompanying drawings and on the basis of several embodiments. In the drawings.

Figure 1:
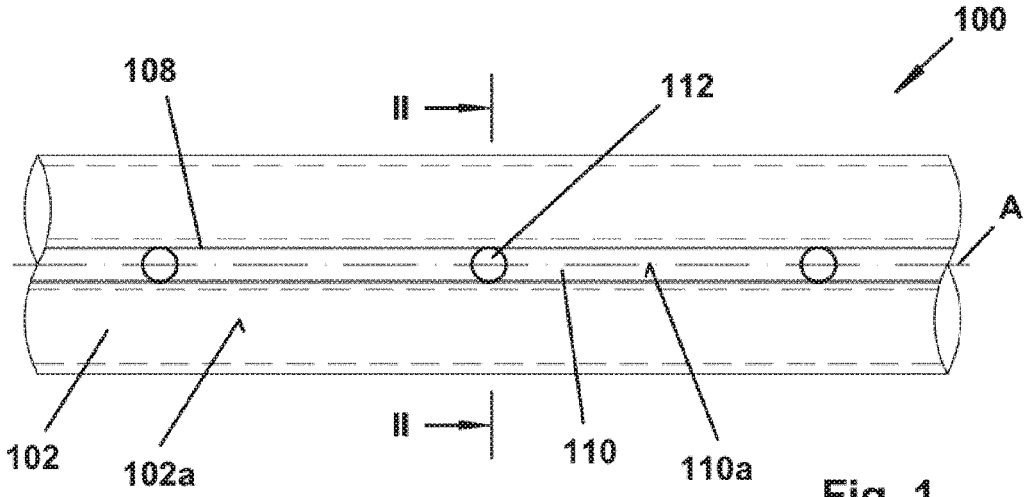
FIG. 1 is a plan view of a first embodiment of a tensioning unit according to the invention.
Figure 2:
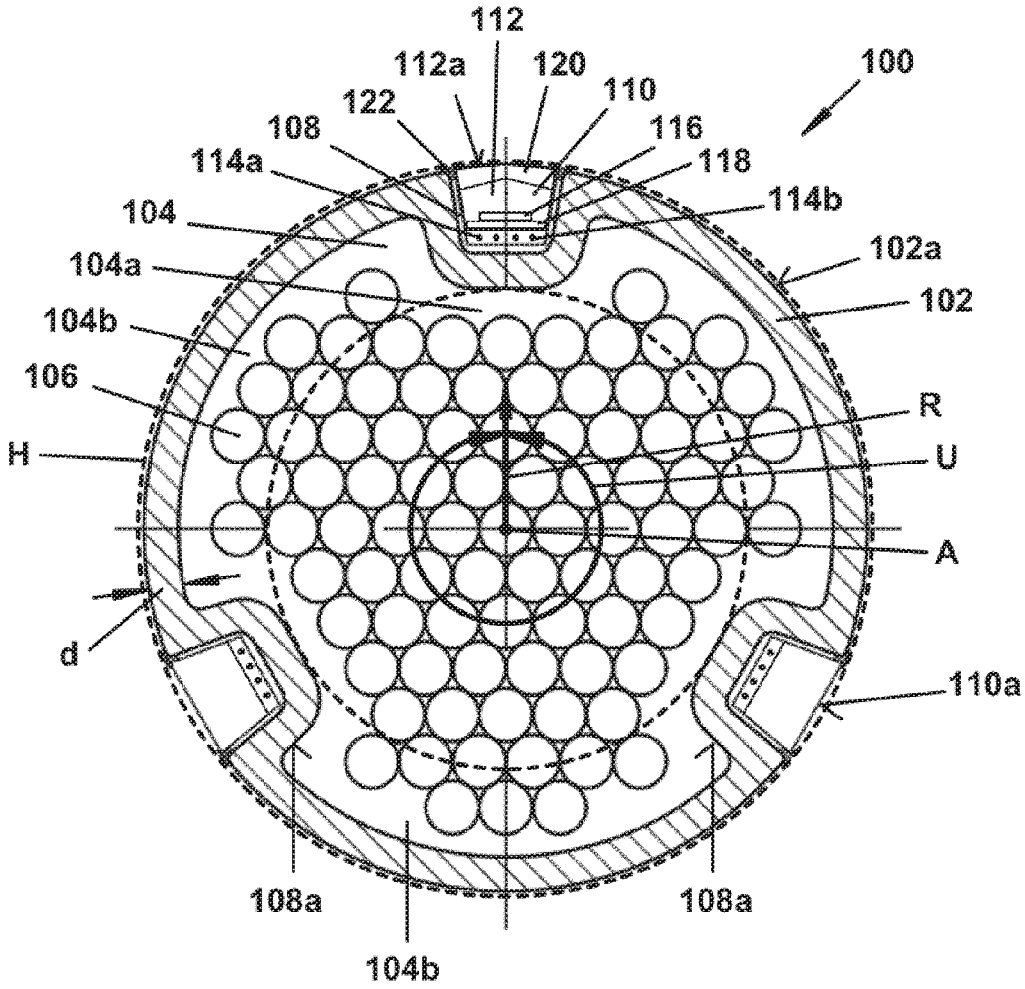
FIG. 2 is a sectional view of the embodiment from FIG. 1 along the line II-II in FIG. 1.

In FIGS. 1 and 2, a first embodiment of a tensioning unit according to the invention is provided, in a very general manner, with reference numeral 100. The tensioning unit 100 comprises a casing 102 which encloses an interior space 104, and a plurality of tensioning elements 106 which extend in the longitudinal direction A of the tensioning unit 100 or the casing 102 and are accommodated in the interior space 104 of the casing 102. According to the invention, in the embodiments shown in FIG. 2, the casing 102 comprises, at each of three circumferential positions, a depression 108 which projects into the interior space 104 and extends, in the embodiments from FIGS. 1 and 2, over substantially the entire length of the casing 102 and thus of the tensioning unit 100.

Rail elements 110 are inserted into the depressions 108 and are equipped with lighting units 112 at predetermined positions. Furthermore, the rail elements 110 comprise connection lines for the lighting units 112, specifically power supply lines 114*a* and data lines 114*b*. The power supply lines 114*a* provide lighting elements 116 of the lighting units 112, preferably formed by LEDs, with the energy required for the operation thereof. By means of the data lines 114*b*, which are connected to a local control unit 118 of the relevant lighting unit 112, it is possible to control when the lighting elements 116 are illuminated and at which intensity and/or in which colour. In order to be able to ensure that the light emitted by the lighting units 112 can be seen over a large solid angle, the lighting units 112 also have a dispersive optical system 120. In order to be able to prevent the ingress of moisture into the depressions 110, seals 122 are arranged at the transition between the outer circumferential surface 102*a* of the casing 102 and the depression 108.

As can be seen in FIG. 2, the casing 102 has a substantially circular cross-sectional surface. Owing to the presence of the depressions 108, this does not, however, apply to the cross-sectional surface of the interior space 104 of the casing 102. Instead, the cross-sectional surface 104*a* of the interior space 104 of the casing 102 has portions 104*b* that are at the same height in the radial direction R, but, in the circumferential direction U, are positioned between two adjacent side delimiting walls 108*a* of adjacent depressions 108. According to the invention, these portions 104*b* can also be used for arranging tensioning elements 106.

Therefore, when the wall thickness d of the casing 102 remains constant per se, despite there being depressions 108 for receiving the lighting units 112, the area of the cross-sectional surface 102*a* of the casing 102 and thus of the entire tensioning unit 100 is only increased slightly, specifically only by the cross-sectional area of the indentations in the casing 102 required for forming the depressions 108.

As is also shown in FIG. 2, the upper peripheral surface 110*a* of the rail elements 110 extends substantially on the extension H of the outer peripheral surface 102*a* of the casing 102 in the circumferential direction U or on the envelope H of the casing 102. The same also applies to the outer peripheral surface 112*a* of the lighting units 112. In this way, the tensioning unit 100 according to the invention that is equipped with the lighting units 112 as an integral part thereof has substantially the same aerodynamic properties as a conventional tensioning unit of the same diameter that is not equipped with lighting units.

So as to be able to replace lighting units 112 that are no longer working properly, according to a first variant, the lighting units 112 can be detachably connected to the rail elements 110. In this case, the rail elements 110 can be connected to the casing 102 of the tensioning unit 100 such that they cannot be detached. According to a second variant, it is however also conceivable for the lighting units 112 to be connected to the rail elements 110 such that they cannot be detached, but for the rail elements 110 to be detachably connected to the casing 102 of the tensioning unit 100.

The detachable connection can be produced, for example, by screwing, locking, clamping, using a bayonet-like connection or the like. In this case, electrical contacts can be produced in a manner known per se. The non-detachable connection can be produced, for example, by adhesion, clips, clamps, screws or the like. In this respect, there does not need to be a connection over the entire length of the rail element 110.

The lighting units 112 and/or the rail elements 110 can be replaced, for example, by means of a robot which can move along the tensioning unit 100 autonomously.

Figure 3:
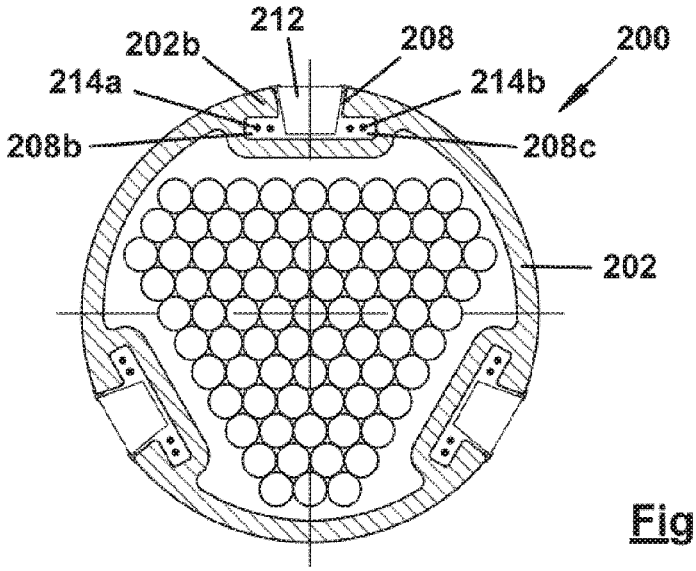
FIGS. 3 to 5 are views similar to FIG. 2 of further embodiments of the tensioning unit according to the invention.

FIG. 3 shows a further embodiment of a tensioning unit according to the invention that substantially corresponds to the embodiment from FIGS. 1 and 2. Therefore, in FIG. 3, similar parts are provided with the same reference numerals as in FIGS. 1 and 2, but increased by 100. Furthermore, in the following, the tensioning unit 200 according to FIG. 3 is only described insofar as it differs from the tensioning unit 100 according to FIGS. 1 and 2, the description of which is otherwise explicitly referred to.

The tensioning unit 200 differs from the tensioning unit 100 primarily on account of the design of the depressions 208. Specifically, the depressions 208 have undercuts 208*b* and 208*c* in which the power supply lines 214*a* and data lines 214*b* are arranged. In this way, the power supply lines 214*a* and the data lines 214*b* can extend in front of and/or behind the lighting unit 212 in the circumferential direction U. This makes it possible to design the depressions 208 so as to have a smaller radial depth, and this has an advantageous effect on the stability of the casing 202. The undercuts 208*b* and 208*c* are delimited radially towards the outside by wall portions 202*b* that are formed in one piece with the casing 202.

Figure 4:
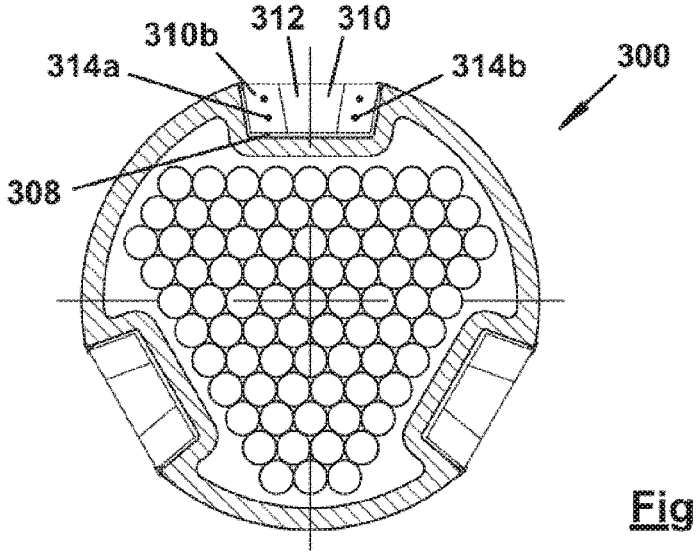

FIG. 4 shows a further embodiment of a tensioning unit according to the invention that substantially corresponds to the embodiment from FIG. 3. Therefore, in FIG. 4, similar parts are provided with the same reference numerals as in FIG. 3, but increased by 100. Furthermore, in the following, the tensioning unit 300 according to FIG. 4 is only described insofar as it differs from the tensioning unit 200 according to FIG. 3, the description of which is otherwise explicitly referred to.

As is also the case in the tensioning unit 200 of the embodiment according to FIG. 3, in the tensioning unit 300, the power supply lines 314*a* and the data lines 314*b* are arranged in front of and/or behind the lighting unit 312 in the circumferential direction U. However, unlike in the tensioning unit 200, the lines 314*a* and 314*b* are not arranged in undercuts in the depressions 308, but rather in side chambers 310*b* of the rail elements 310. In this embodiment too, the advantage is produced whereby the depressions 308 have a smaller radial depth.

Figure 5:
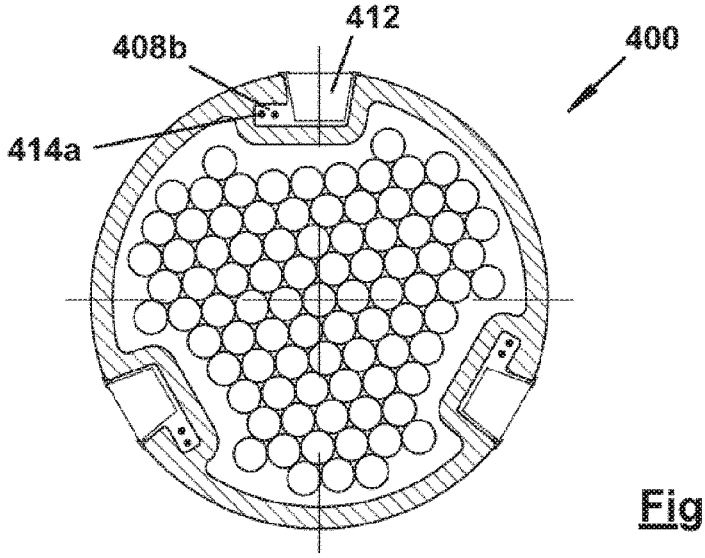

FIG. 5 shows a further embodiment of a tensioning unit according to the invention that substantially corresponds to the embodiment from FIG. 3. Therefore, in FIG. 5, similar parts are provided with the same reference numerals as in FIG. 3, but increased by 200. Furthermore, in the following, the tensioning unit 400 according to FIG. 5 is only described insofar as it differs from the tensioning unit 200 according to FIG. 3, the description of which is otherwise explicitly referred to.

The tensioning unit 400 differs from the tensioning unit 200 according to FIG. 3 merely in that it only comprises one single undercut 408*b*. Although both the power supply lines and the data lines can be housed in this undercut, in the view according to FIG. 5 the tensioning unit 400 only has power supply lines 414*a*. The lighting units 412 can thus only be switched on and off, but the intensity and/or colour thereof cannot be controlled.

Figure 6:
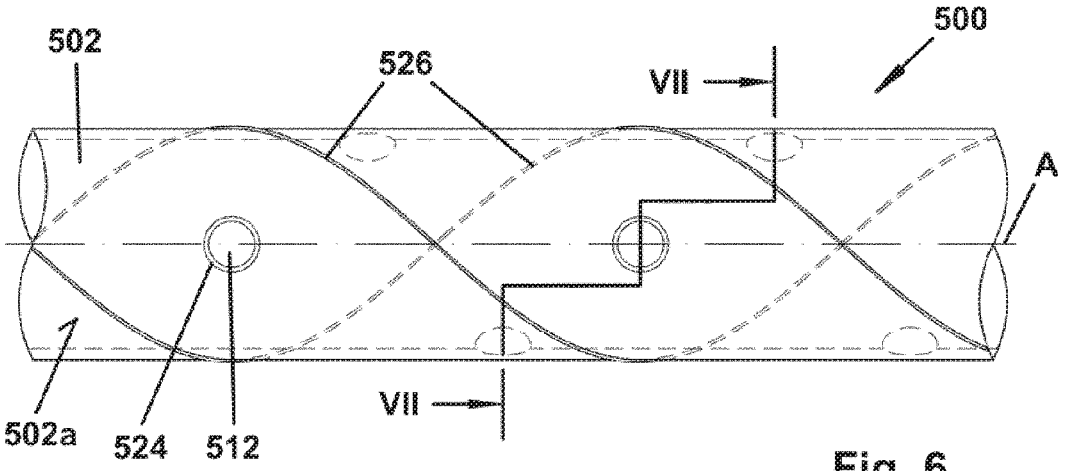
FIG. 6 is a plan view similar to FIG. 1 of a further embodiment of a tensioning unit according to the invention.
Figure 7:
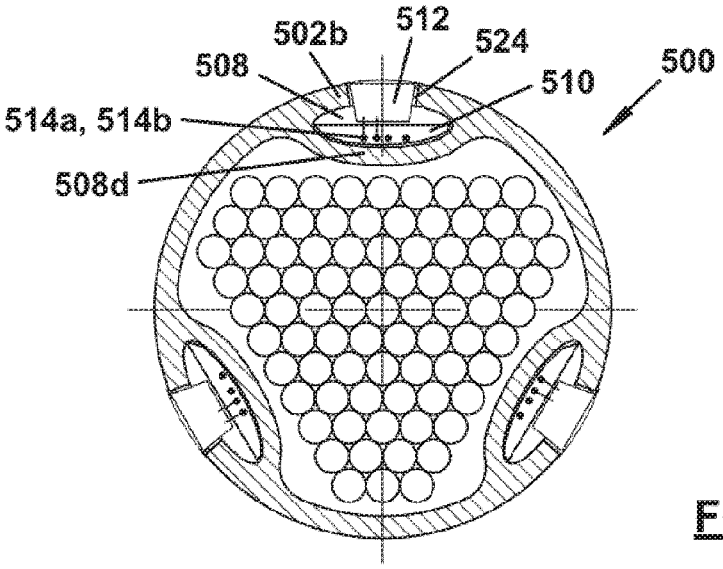
FIG. 7 is a sectional view of the embodiment from FIG. 6 along the line VII-VII in FIG. 6.

FIGS. 6 and 7 show a further embodiment of a tensioning unit according to the invention that substantially corresponds to the embodiment from FIGS. 1 and 2. Therefore, in FIGS. 6 and 7, similar parts are provided with the same reference numerals as in FIGS. 1 and 2, but increased by 400. Furthermore, in the following, the tensioning unit 500 according to FIGS. 6 and 7 is only described insofar as it differs from the tensioning unit 100 according to FIGS. 1 and 2, the description of which is otherwise explicitly referred to.

The tensioning unit 500 differs from the tensioning unit 100 primarily in that the depressions 508 are designed so as not to be open radially towards the outside over the entire length of the casing 502 or the tensioning unit 500, but rather the casing 502 only has apertures 524 leading into the depressions 508 at positions at which lighting units 512 are intended to be arranged. Otherwise, the depressions 508 are covered by wall portions 502*b* of the casing 502. As a result of this design, the casing 502 is highly stable.

There are no restrictions at all in respect of the design of the inner delimiting wall 508*d* of the depressions 508. Instead of the course shown in FIG. 7, any other course can also be used, for example the courses shown in FIGS. 3 to 5.

The connection lines 514*a* and 514*b* are advantageously arranged in rail elements 510 which are introduced into the depressions 508 in the longitudinal direction A of the tensioning unit 500. The lighting units 512 are detachably connected to these rail elements 510.

Two water-repelling elements 526 can also be seen in FIG. 6, which water-repelling elements are arranged on the outer surface 502*a* of the casing 502 so as to wind thereabout quasi in the manner of a double helix. In this case, the apertures 524 for arranging the lighting units 512 are preferably arranged such that they are located approximately centrally between the two water-repelling elements 526.

Figure 8:
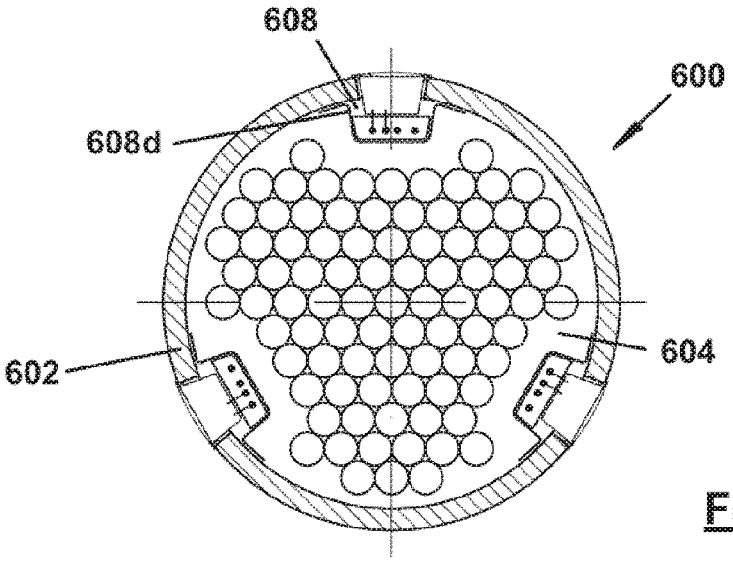
FIG. 8 is a view similar to FIG. 7 of a further embodiment of the tensioning unit according to the invention.

FIG. 8 shows a further embodiment of a tensioning unit according to the invention that substantially corresponds to the embodiment from FIG. 7. Therefore, in FIG. 8, similar parts are provided with the same reference numerals as in FIG. 7, but increased by 100. Furthermore, in the following, the tensioning unit 600 according to FIG. 8 is only described insofar as it differs from the tensioning unit 500 according to FIG. 7, the description of which is otherwise explicitly referred to.

The tensioning unit 600 according to FIG. 8 differs from the tensioning unit 500 merely in that the inner delimiting wall 608*d* of the depressions 608 is not formed in one piece with the casing 602. Instead, the inner delimiting wall 608*d* is provided as an element that is separate from the casing 602, is introduced into the interior space 604 of the casing 602 during production of the tensioning unit 600 and is connected to the inside of the casing 602 for operation therewith. This separate element can be made of steel, for example.

Figure 9:
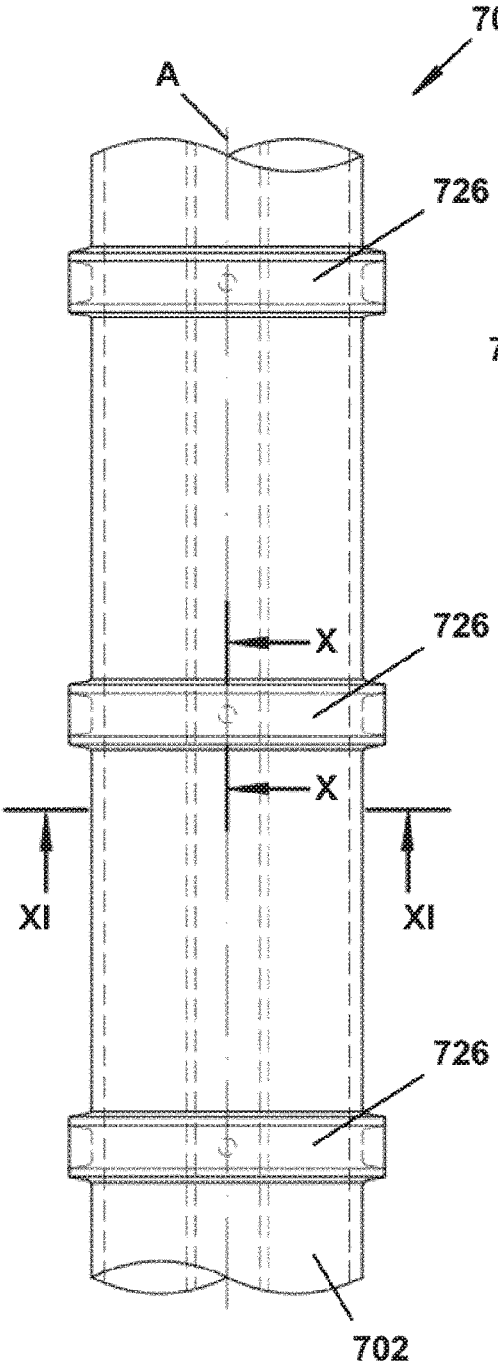
FIG. 9 is a plan view similar to FIG. 1 of a further embodiment of a tensioning unit according to the invention.
Figure 10:
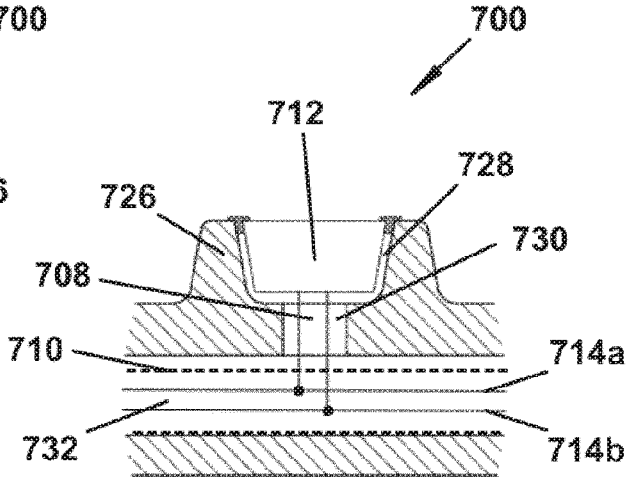
FIG. 10 is a sectional view of the embodiment from FIG. 9 along the line X-X in FIG. 9.
Figure 11:
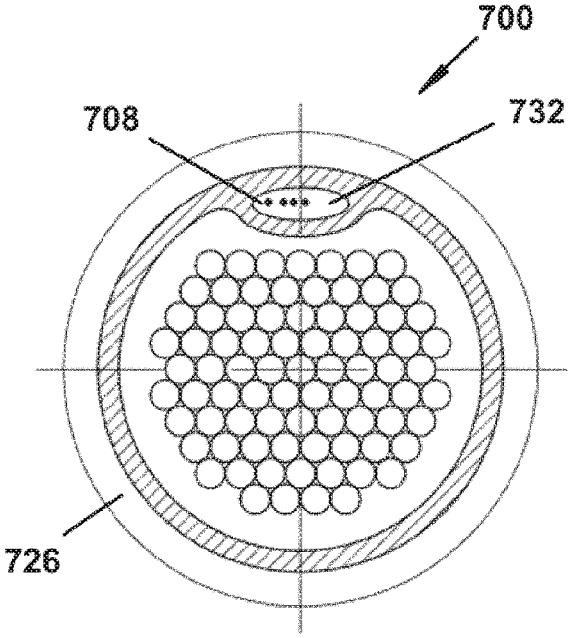
FIG. 11 is a sectional view of the embodiment from FIG. 9 along the line XI-XI in FIG. 9.

FIGS. 9 to 11 show a further embodiment of a tensioning unit according to the invention that substantially corresponds to the embodiment from FIGS. 6 and 7. Therefore, in FIGS. 9 to 11, similar parts are provided with the same reference numerals as in FIGS. 6 and 7, but increased by 200. Furthermore, in the following, the tensioning unit 700 according to FIGS. 9 to 11 is only described insofar as it differs from the tensioning unit 500 according to FIGS. 6 and 7, the description of which is otherwise explicitly referred to.

The tensioning unit 700 also has water-repelling elements 726 which, unlike the water-repelling elements 526 of the tensioning unit 500 according to FIG. 6, are annular and are arranged substantially orthogonally to the longitudinal axis A of the tensioning unit 700. This tensioning unit also differs from the embodiment from FIGS. 6 and 7 in that the water-repelling elements 726 comprise recesses 728 in which the lighting units 712 are arranged. These recesses 728 are connected, by means of apertures 730, to channels 732 that extend in the longitudinal direction A of the casing 702 of the tensioning unit 700. The channels 732, the apertures 730 and the recesses 728 together form the depressions 708 in the tensioning unit 700. The power supply lines 714*a* and the data lines 714*b* are arranged in the channels 732. In particular, the lines 714*a* and 714*b* can be accommodated in rail elements 710 as in the embodiment from FIGS. 6 and 7.

Figure 12:
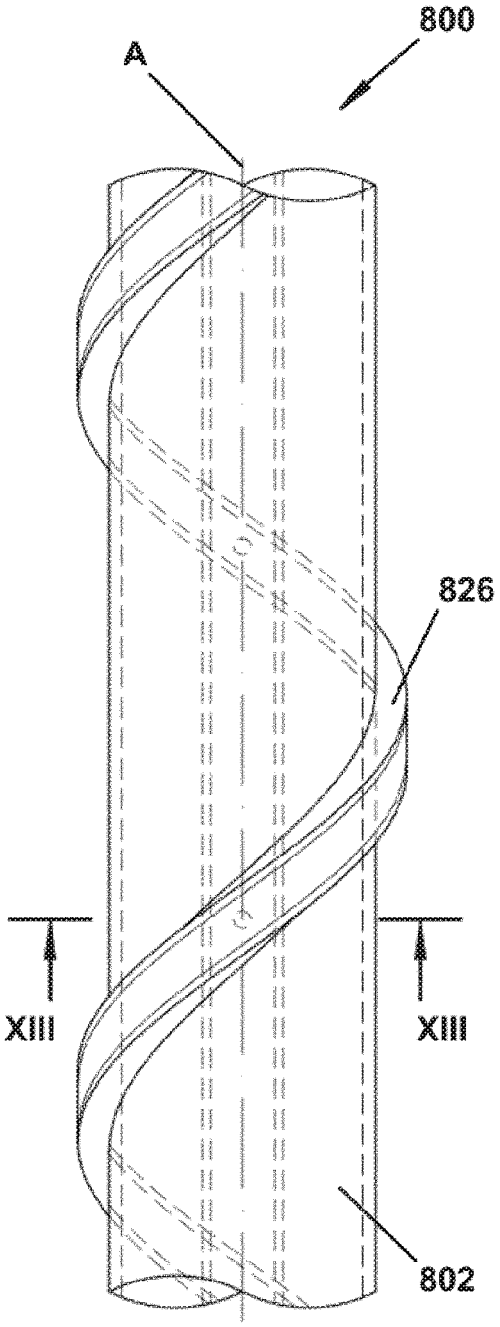
FIG. 12 is a plan view similar to FIG. 1 of a further embodiment of a tensioning unit according to the invention.
Figure 13:
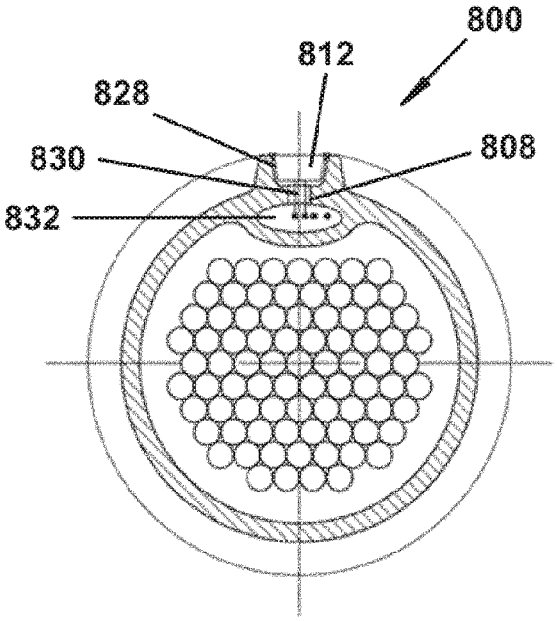
FIG. 13 is a sectional view of the embodiment from FIG. 12 along the line XIII-XIII in FIG. 12.

FIGS. 12 and 13 show a further embodiment of a tensioning unit according to the invention that substantially corresponds to the embodiment from FIGS. 9 to 11. Therefore, in FIGS. 12 and 13, similar parts are provided with the same reference numerals as in FIGS. 9 to 11, but increased by 100. Furthermore, in the following, the tensioning unit 800 according to FIGS. 12 and 13 is only described insofar as it differs from the tensioning unit 700 according to FIGS. 9 to 11, the description of which is otherwise explicitly referred to.

The tensioning unit 800 according to FIGS. 12 and 13 differs from the tensioning unit 700 from FIGS. 9 to 11 merely in that, like in the embodiment according to FIG. 6, the water-repelling element 826 is again designed in the manner of a helix, only one single helix being provided in the embodiment from FIG. 12, however. Nevertheless, it goes without saying that two helices that wind around one another in the manner of a double helix could be provided.

As is the case in the tensioning unit 700 from FIGS. 9 to 11, in the tensioning unit 800, the lighting units 812 are also accommodated in recesses 828 that are connected, by means of apertures 830, to a channel 832 that extends in the longitudinal direction A of the tensioning unit 800. In this case too, the recesses 828, apertures 830 and the channel 832 together form the depressions 808 in the casing 802.

Figure 14:
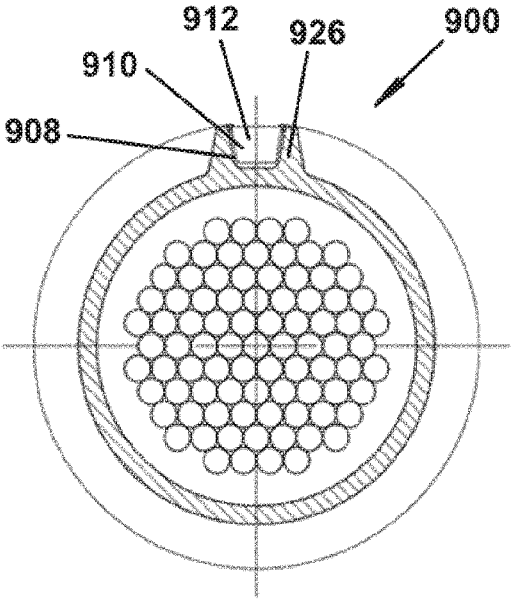
FIG. 14 is a view similar to FIG. 13 of a further embodiment of a tensioning unit according to the invention.

FIG. 14 shows a further embodiment of a tensioning unit according to the invention that substantially corresponds to the embodiment from FIGS. 1 and 2. Therefore, in FIG. 14, similar parts are provided with the same reference numerals as in FIGS. 1 and 2, but increased by 800. Furthermore, in the following, the tensioning unit 900 according to FIG. 14 is only described insofar as it differs from the tensioning unit 100 according to FIGS. 1 and 2, the description of which is otherwise explicitly referred to.

Although the tensioning unit 900 is very similar to the tensioning unit 800 from FIGS. 12 and 13, it corresponds to the tensioning unit 100 from FIGS. 1 and 2 to a large extent. Specifically, like the tensioning unit 800, the tensioning unit 900 also has a water-repelling element 926 designed in the manner of a helix. However, like in the tensioning unit 100, the lighting units 912 are arranged in rail elements 910 which are inserted into a depression 908 that extends over the entire length of the helix 926.

The invention claimed is:

1. An elongate tensioning unit comprising a casing which encloses an interior space, and a plurality of tensioning elements which extend in a longitudinal direction of the tensioning unit and are accommodated in the interior space of the casing, wherein the casing comprises, at least one circumferential position, a depression which projects into the interior space and in which at least one electric functional unit and at least one connection line for the at least one electric functional unit are accommodated.

2. The tensioning unit according to claim 1, wherein the casing is designed having no hollow regions.

3. The tensioning unit according to claim 1, wherein the at least one depression extends over at least a predetermined fraction of the length of the tensioning unit.

4. The tensioning unit according to claim 1, wherein the at least one depression comprises a top wall which extends in an extension of the circumferential extent of the outer surface of the casing.

5. The tensioning unit according to claim 4, wherein the top wall is formed at least in portions by a rail element inserted into a relevant depression of the at least one depression.

6. The tensioning unit according to claim 4, wherein the top wall is formed in one piece with the casing at least in part.

7. The tensioning unit according to claim 4, wherein the top wall comprises a plurality of apertures that corresponds to a number of the at least one electric functional units.

8. The tensioning unit according to claim 1, wherein the at least one connection line is an energy supply line and/or a data line for establishing a unidirectional or bidirectional data connection to the at least one electric functional unit.

9. The tensioning unit according to claim 1, wherein the at least one connection line extends in front of and/or behind the electric functional unit when viewed in the circumferential direction.

10. The tensioning unit according to claim 1, wherein the casing has a substantially circular cross section.

11. The tensioning unit according to claim 1, wherein at least one sealing elements arc is assigned to the depression.

12. The tensioning unit according to claim 1, wherein the at least one electric functional unit can be detachably connected to the casing.

13. The tensioning unit according to claim 1, wherein an inner delimiting wall of the depression is formed in one piece with the casing.

14. The tensioning unit according to claim 1, wherein an inner delimiting wall of the depression is designed as a separate element that is connected to the casing for operation therewith.

15. The tensioning unit according to claim 1, wherein the at least one electrical functional unit is at least one lighting unit and the at least one lighting unit comprises at least one lamp.

16. The tensioning unit according to claim 15, wherein the at least one lighting unit comprises an integrated optical system.

17. The tensioning unit according to claim 15, wherein the at least one lightning unit comprises a local control unit.

18. The tensioning unit according to claim 1, wherein at least some of the tensioning elements are designed as strands.

19. The tensioning unit according to claim 1, wherein at least one water-repelling element is arranged on an outer surface of the casing.

20. An elongate tensioning unit comprising a casing which encloses an interior space, and a plurality of tensioning elements which extend in a longitudinal direction of the tensioning unit and are accommodated in the interior space of the casing, wherein at least one water-repelling element is arranged on an outer surface of the casing, the at least one water-repelling element comprises at least one recess in which at least one electric functional unit is accommodated, and in that said tensioning unit also comprises at least one connection line for the at least one electric functional unit.

21. The tensioning unit according to claim 20, wherein the at least one connection line is accommodated in a channel which is formed in the at least one water-repelling element.

22. The tensioning unit according to claim 20, wherein the casing comprises, at at least one circumferential position, a depression which projects into the interior space and in which the at least one connection line is accommodated.

* * * * *